US005165978A

United States Patent [19]

Lecinski

[11] Patent Number: 5,165,978

[45] Date of Patent: Nov. 24, 1992

[54] CLOSURE PANEL CONSTRUCTION FOR COMPOSITE CLOSURE

[75] Inventor: Frank H. Lecinski, Champaign, Ill.

[73] Assignee: Continental White Cap, Inc., Downers Grove, Ill.

[21] Appl. No.: 488,246

[22] Filed: Mar. 5, 1990

[51] Int. Cl.[5] ..... B32B 3/02; B65D 21/00

[52] U.S. Cl. ..... 428/66; 428/81; 428/124; 428/130; 428/177; 428/192; 428/212; 206/508; 206/529; 215/324; 215/331; 215/337

[58] Field of Search ..... 428/156, 64, 81, 83, 428/157, 172, 167, 66, 192, 33, 119, 121, 130, 124, 127, 128, 174, 177, 212; 206/505-519; 215/324, 331, 337, 316, 333, 323, 340, 328

[56] References Cited

U.S. PATENT DOCUMENTS 1,381,364 6/1921 Taliaferro ..... 215/333
2,223,742 12/1940 Scofield ..... 215/333
3,123,241 3/1964 Nofer et al. ..... 215/328

*Primary Examiner*—Ellis P. Robinson
*Assistant Examiner*—Donald J. Loney
*Attorney, Agent, or Firm*—Lockwood, Alex, Fitzgibbon & Cummings

[57] ABSTRACT

This relates to the special construction of shells for closure panels of composite closures which, in production, for all practical purposes will eliminate nesting of stacked closure panels. Most specifically, each closure panel will be provided with flutes indenting the skirts thereof so as to prevent closure panels from nesting when stacked. Preferably, each closure panel is provided with at least three flutes and preferably four with the circumferential spacing of the flutes of a closure panel all being different and when the shells of the closure panels are formed in a multiple cavity die, the flute arrangement in each cavity will also be different. This will, for all practical purposes, eliminate nesting of the closure panels when stacked during production.

7 Claims, 2 Drawing Sheets

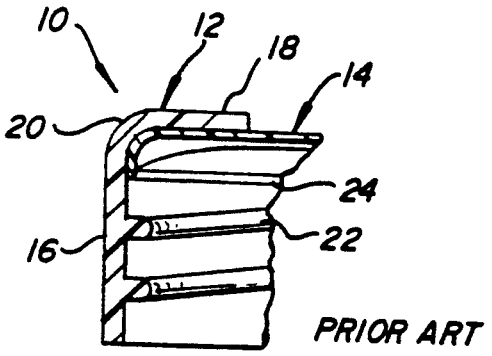
FIG. 1
FIG. 2
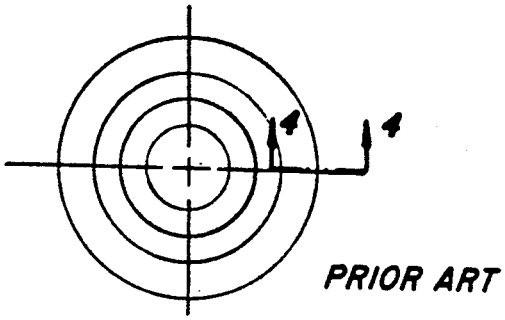
FIG. 3
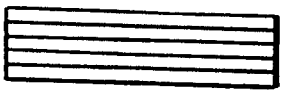
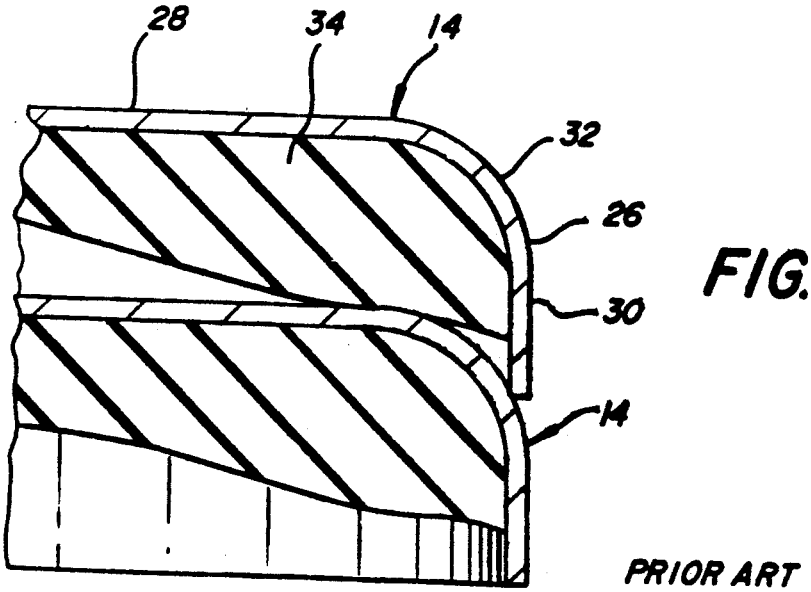
FIG. 4

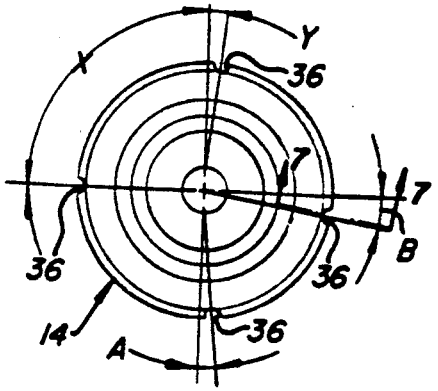
FIG. 5
FIG. 6
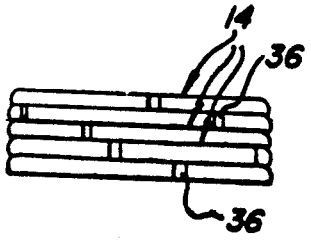
FIG. 8
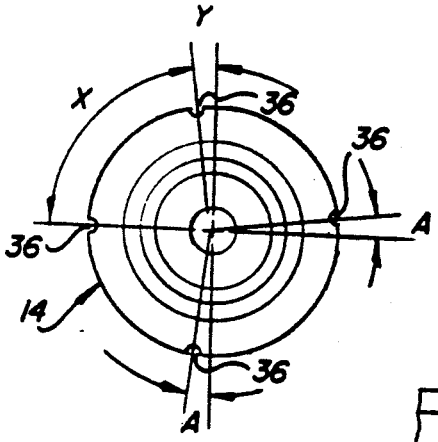
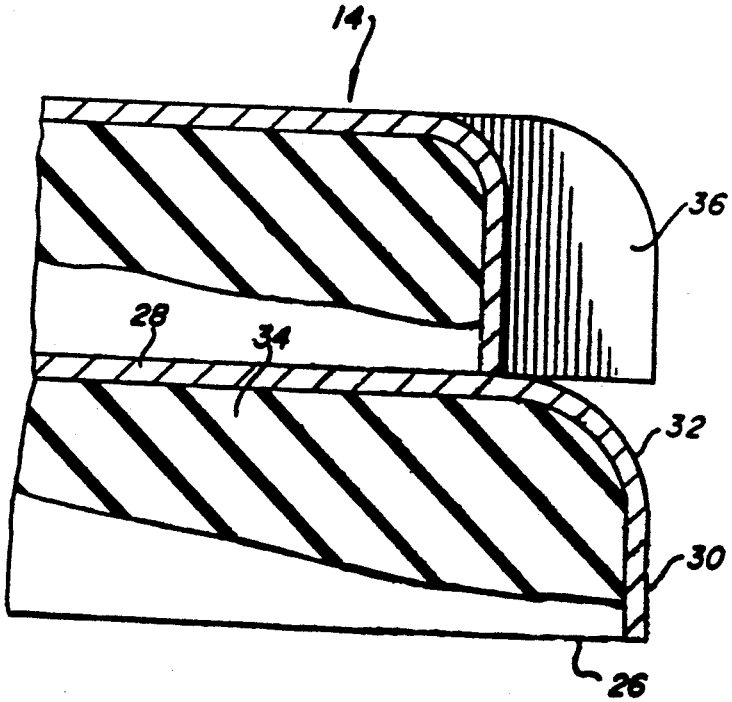
FIG. 7

CLOSURE PANEL CONSTRUCTION FOR COMPOSITE CLOSURE

This invention relates in general to new and useful improvements in the construction of closure panels of composite closures of the type which includes an outer ring member having means for releasable securement to a container neck finish and an inner closure panel which is seated within the ring member and is provided with a sealant for sealing engagement with a container neck finish. The invention in particular relates to providing such closure panels with flute or rib means so as to prevent nesting when a plurality of such closure panels are nested.

Composite closures of the type including an outer ring member, normally now made of plastic, and having means (threads) for interlocking engagement with a container neck finish and an inner closure panel are well known. Such inner closure panels are presently primarily formed of metal and are of a generally inverted cup shape including an end panel and a depending cylindrical skirt joined to the end panel by a radius. The closure panel carries a suitable sealant, such as plastisol, for forming a proper seal between the composite closure and an associated container. After the closure panels are formed, they are filled with the sealant and then stacked for assembly with the ring member. However, these presently constructed closure panels, when stacked, will nest with the sealant engaging the outer surface of the end panel.

In accordance with this invention, the closure panels are modified in a manner wherein the skirt is provided with at least one radially inwardly directed flute or rib so as to prevent nesting.

Most particularly, the radial depth of the flute should be, at a minimum, equal to the radius. More particularly, the radially inner part of the flute should engage on the end panel so as to prevent any nesting whatsoever of the stacked closure panels.

In a preferred embodiment of the invention, each closure panel or metal shell may be provided with four such flutes with the circumferential spacing between the flutes being different. In addition, it is preferred that the metal shells be formed in a multiple cavity die with each cavity being with a different flute arrangement so that even when the closure panels are rotated so that certain of the flutes align with one another, not all flutes will be in alignment.

With the above and other objects in view that will hereinafter appear, the nature of the invention will be more clearly understood by reference to the following detailed description, the appended claims, and the several views illustrated in the accompanying drawings.

FIG. 1 is a fragmentary vertical sectional view taken through a conventional composite closure to which this invention relates.

FIG. 2 is a top plan view of the uppermost closure panel in a stack of closure panels.

FIG. 3 is an elevational view of the stack of closure panels of FIG. 2.

FIG. 4 is an enlarged fragmentary vertical sectional view taken through the top two closure panels of the stack of closure panels generally along the line 4—4 of FIG. 2 and shows the nesting and interlocking of the stacked closure panels.

FIG. 5 is a top plan view similar to FIG. 2 of a stack of closure panels wherein the closure panels are provided with flutes in accordance with this invention.

FIG. 6 is an elevational view of the stack of closure panels and shows the various arrangements of the flute of individual closure panels in the stack.

FIG. 7 is an enlarged fragmentary sectional view taken through the two upper closure panels of the stack of FIGS. 5 and 6 and shows how a typical flute prevents nesting of the vertically adjacent closure panels.

FIG. 8 is a planned view similar to FIG. 5 of another closure panel with a different flute arrangement which will not nest with the flute arrangement of FIG. 5.

Referring now to the drawings in detail, reference is first made to FIG. 1 wherein there is illustrated a typical composite closure formed in accordance with this invention. The closure, which is generally identified by the numeral 10, includes a ring member, generally identified by the numeral 12, and a closure panel generally identified by the numeral 14.

The ring member 12 is preferably formed of plastic and includes an enlongated skirt 16 and a ring portion 18 with the skirt and the ring portion being joined together by a radius 20. The inner surface of the skirt 16 is provided with suitable means for interlocking with a container neck finish (not shown). Such interlocking means may be in the form of threads 22 as is illustrated.

The inner surface of th skirt 16 may also be provided with a small circumferential rib 24, which may be suitably interrupted, if desired. The rib 24 will serve to hold the closure panel 14 in place.

With reference to FIG. 4, it will be seen that each closure panel 14 includes a metal shell 26 which is generally cup shaped in configuration. The metal shell 26 includes an end panel 28 and a short, generally cylindrical skirt 30. The skirt 30 is integrally joined to the end panel 28 by a radius 32. The cup shaped metal shell 26 is filled with a suitable sealant 34, such as plastisol.

In the manufacture of the composite closure 10, the metal shells 26 are formed in a multiple cavity die (not shown) so that a plurality of certain shells 26 are simultaneously formed. The shells 26 are then filled with the sealant 34. At this time, the completed closure panels 14 are then stacked and ready for assembly with the plastic rings 12. This is clearly shown in FIG. 3.

The trouble with the present closure panel configuration is clearly shown in FIG. 4 wherein the lower portion of the skirt 30 telescopes down over the upper part of the shell 26 and the underside of the sealant 34 touches the upper surface of the end panel 28. Thus, not only are the closure panels 14 undesirably nested or interlocked with one another, but also part of the sealant 34 sticks to and appears on the outer surface of the end panel 28.

In accordance with this invention and as best shown in FIGS. 5–8, in lieu of the skirt 30 being completely cylindrical, the skirt 30 is provided with at least one flute 36 which is radially inwardly directed. The flute or rib 36 extends the full height of the closure panel 14, as is shown in FIG. 7, and must have a radial depth equal to the radius R of the radius 32.

Referring now to FIG. 5 in particular, it will be seen that in accordance with this invention, while one radius will prevent nesting between stacked closure panels, it will also be apparent that tilting will most likely be effected and, therefore, there should be at least three of the flutes 36 although four are preferred. On the one hand, the flutes 36 are preferably not 90° apart in that, assuming that each closure panel 14 is rotated 1°, there would be one chance in 90 of the flutes or lining. On the other hand, as is shown in FIG. 5, starting with a first flute, the next flute should be spaced circumferentially greater than 90° by a distance Y. Then, the third flute may be spaced from the first flute a distance greater than 108° by a distance B which will be different from the distance Y. Finally, the fourth flute may be spaced in acounterclockwise direction from the first flute a distance A greater than 90°. Thus with the flute arrangement of FIG. 5, and assuming that each closure panel 14 is rotated 1°, there will be a matching of the flutes only once in 360 times. Further, it is to be understood that the shells 26 are formed in a ten cavity die wherein the flute pattern in each cavity is different. Thus the chances of two identical shells becoming aligned with one another is greatly increased so as to be on the order of 1 in 12,960,000. If annual production of the shells 28 is 100 mm, then 7.7 times a year two identical shells will sit on and nest with one another.

Although only a preferred form closure panel has been specifically illustrated and described herein, it is to be understood that minor variations may be made in the closure panels, including the depths of the flutes, without departing from the spirit and scope of the invention as defined by the appended claims.

I claim:

1. A plurality of stackable closure panels for a composite closure which also includes a retaining ring, said closure panels, including an end panel, and a depending cylindrical skirt joined to said end panel by a radius, said closure panels being improved by said cylindrical skirt having a plurality of radially inwardly directed flutes, at least one of said radially inwardly directed flutes circumferentially, asymmetrically positioned with respect to the flutes of the cylindrical skirt of an underlying closure panel for engaging said underlying closure panel to prevent nesting between adjacent closure panels when said panels are stacked.

2. An improved closure panel according to claim 1 wherein said flute is of a radial depth to extend radially inwardly beyond said radius and into said end panel whereby said flute will engage an end panel of a next lower closure panel.

3. An improved closure panel according to claim 2 wherein said closure panel contains a sealant, and said flute is of a radial depth to prevent said sealant from engaging an outer face of an end panel of a next lower closure panel.

4. An improved closure panel according to claim 1 wherein said closure panel contains a sealant, and said flute is of a radial depth to prevent said sealant from engaging an outer face of an end panel of a next lower closure panel.

5. An improved closure panel according to claim 1 wherein the radial depth of said flute is at least equal to said radius.

6. An improved closure panel according to claim 1 where the number of flutes is at least four.

7. An improved closure panel according to claim 1 where a plurality of closure panels has a plurality of flute patterns.

* * * * *